US005422705A

United States Patent [19]

Omelchenko et al.

[11] Patent Number: 5,422,705

[45] Date of Patent: Jun. 6, 1995

[54] SYSTEM FOR SELECTIVELY VARIABLE SET DELIVERY OUTPUT IN AN ELECTROSTATOGRAPHIC PRINTING MACHINE

[75] Inventors: Mark A. Omelchenko, Penfield; Frederick A. Scacchitti; Saundra L. W. Haque, both of Rochester; David W. Covert, Ontario; Kisha H. Salters, Rochester; Patricia J. Weber, Fairport, all of N.Y.

[73] Assignee: Xerox Corporation, Stamford, Conn.

[21] Appl. No.: 99,275

[22] Filed: Jul. 29, 1993

[51] Int. Cl.[6] ..... G03G 21/00

[52] U.S. Cl. ..... 355/208; 355/321; 355/323; 355/324

[58] Field of Search ..... 355/203, 204, 205, 207, 355/208, 313, 314, 321, 322, 323, 324

[56] References Cited

U.S. PATENT DOCUMENTS

| | | | |
|---|---|---|---|
| 3,989,371 | 11/1976 | Valentine | 355/313 |
| 4,035,072 | 7/1977 | Deetz et al. | 355/204 |
| 4,603,971 | 8/1986 | Kukucka et al. | 355/224 X |
| 5,086,309 | 2/1992 | Iida et al. | 355/223 X |
| 5,095,369 | 3/1992 | Oritz et al. | 358/296 |
| 5,164,769 | 11/1992 | Hashimoto et al. | 355/323 |
| 5,184,185 | 2/1993 | Rasmussen et al. | 355/308 |
| 5,221,973 | 6/1993 | Miller et al. | 355/205 X |

*Primary Examiner*—A. T. Grimley
*Assistant Examiner*—Nestor R. Ramirez
*Attorney, Agent, or Firm*—Denis A. Robitaille

[57] ABSTRACT

An electrostatographic printing machine including a system for selectively varying set delivery output time from a finishing subsystem to an external device such as a third party supplemental finishing apparatus. The system is adapted to allow an operator to input certain parameters such as the unload time of the external device, and the number of sheets per set for adjusting the machine output so as to be compatible with the unload time of the external device. Control circuitry is provided for inducing delays in the finishing subsystem or in the electrostatographic printing system, as desired.

21 Claims, 5 Drawing Sheets

SYSTEM FOR SELECTIVELY VARIABLE SET DELIVERY OUTPUT IN AN ELECTROSTATOGRAPHIC PRINTING MACHINE

This invention relates to electrostatographic printing machines, and, more particularly, to an electrostatographic printing system having an operator adjustable timing option for selectively varying the time interval at which print sets are delivered to an external third party device.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The primary output product for a typical electrostatographic printing system is a printed copy substrate such as a sheet of paper bearing printed information in a specified format. Quite often, customer requirements necessitate that this output product be configured in various specialized arrangements ranging from stacks of collated loose printed sheets to tabulated and bound booklets. Some products do not have the capability to prepare a full range of customer required output product configurations such that the users of such equipment may be required to take the output product to an off-line location for further finishing operations. This limitation hampers production efficiency and generates an undue expense by requiring the additional processing step of manually transporting output product from one operation site to another.

Typically, in high-speed commercial printing applications, large volumes of unfinished sets of copy sheets are fed onto a stacking tray where the operator can readily remove the finished or unfinished sets of copy sheets. However, more recently, various external output devices have been designed for connection to an electrostatographic printing machine or the like, wherein output product generated by the electrostatographic printing system can be ejected therefrom and passed to an external device, as for example a sorter or a signature booklet maker. For example, U.S. Pat. No. 4,515,458 discloses a copying machine having a sorter connected to wherein the copying machine can be operated in either a book mode or a sheet mode and the third party external device is a sorter which can be selected to operate in a collator or a sorter mode. It is desirable to have a system that will deliver each individual compiled set to the external finishing device, wherein a critical parameter in such delivery is the capability to operate at process speed so as to not inhibit the function of the printing machine.

Finishing activities, such as sorting, collating, stitching, and/or binding generally require the movement of mechanical components and the reconfiguration of specific automated mechanisms. In state-of-the-art electrostatographic printing machines, it is common to have a quantity of jobs in a job stream which require various sorts of finishing activities. In order to accommodate multiple jobs, each job in a job stream is typically held or delayed until the finishing activity of the preceding job has been completed. Moreover, it is often imperative to delay the output speed of the printing machine so as not to exceed the rate at which the external device can receive sets of output documents for producing the final output product. These finishing delay times detract from the overall productivity of the printing system. Thus, it is desirable to provide an operator with the capability to selectively adjust or vary the timing for document set output delivery to accommodate varying external device unload time capabilities. Since more than one external device may be incorporated into various print jobs, a universal approach to set delivery is preferred.

Various techniques are known for enabling multiple programming logic to provide timing for various interacting subsystem components. The prior art, however, does not disclose a system for providing an operator with the capability to selectively vary the timing of set delivery output for those jobs requiring finishing operations to be performed by an external or so-called third party device. The following disclosures appear to be relevant:

U.S. Pat. No. 5,095,369
Patentee: Ortiz et al.
Issued: Mar. 10, 1992
U.S. Pat. No. 4,035,072
Patentee: Deetz et al.
Issued: Jul. 12, 1977
U.S. Pat. No. 3,989,371
Patentee: Valentine
Issued: Nov. 2, 1976

The relevant portions of the foregoing disclosures may be briefly summarized as follows:

U.S. Pat. No. 5,095,369 discloses a method and apparatus for improved job stream printing in an electronic printer with various finishing functions, wherein productivity in a job streaming mode is enhanced by utilizing software to calculate and predict the minimum delay corresponding to minimum skip pitches in successive jobs requiring finishing activities. Printing and collating of sets of original scanned documents are controlled so that collated sets are successively presented by the printer to the finisher nearly coincident with conclusion of the finishing activity being accomplished by a current job.

U.S. Pat. No. 4,035,072 discloses a programmable controller consisting of a control program comprising a set of program instructions which enables the controller to generate a control signal to begin a process device in a timed manner. In operating the device, the control program calculates the timing information in order to control the operating components of the machine in response to specific instructions.

U.S. Pat. No. 3,989,371 to Valentine discloses a multi-mode copier/duplicator which includes a delay in mode change in response to an operator command in order to avoid any interruptions for a copying process. The delay mode is a change in logic in a cycle-out logic circuit wherein a signal is initiated by the operator to change one mode to another.

It is therefore, desirable to provide an electrostatographic copying system adapted to provide an operator with the capability of selectively adjusting the timing for set delivery to manipulate the set delivery time from the finisher in order to accommodate varying external device unload time and throughput capabilities. This set delivery time is dependent upon the unload times of the external device as well as the number of sheets in a given print set. The operator is further provided with the capability to update the relevant external device information through a customized user interface screen.

In accordance with one aspect of the invention, an apparatus for delivering successive print sets to an external device at a selectively variable time intervals is provided, comprising means for compiling a plurality of print sheets to produce a print set, the compiling means being adapted to deliver the print sets to the external device adapted to receive print sets at a predetermined unload rate, and the apparatus further including means for selectively varying the time interval at which individual print sets are delivered from the compiling means to the external device so as to be compatible with the predetermined unload rate thereof.

In accordance with another aspect of the present invention, an electrostatographic printing apparatus for printing and finishing a plurality of print jobs is provided, comprising means for printing a plurality of print sheets, finishing means for compiling a plurality of the print sheets in accordance with a particular print job to produce a plurality of successive print sets, the finishing means being adapted to deliver the print sets to an external device adapted to receive print sets at a predetermined unload rate, and means for selectively varying a time interval at which individual print sets are delivered from the finishing means to the external device so as to be compatible with the predetermined unload rate of the external device.

For a general understanding of the present invention, as well as other aspects thereof, reference is made to the following description and drawings, in which.

Figure 4:
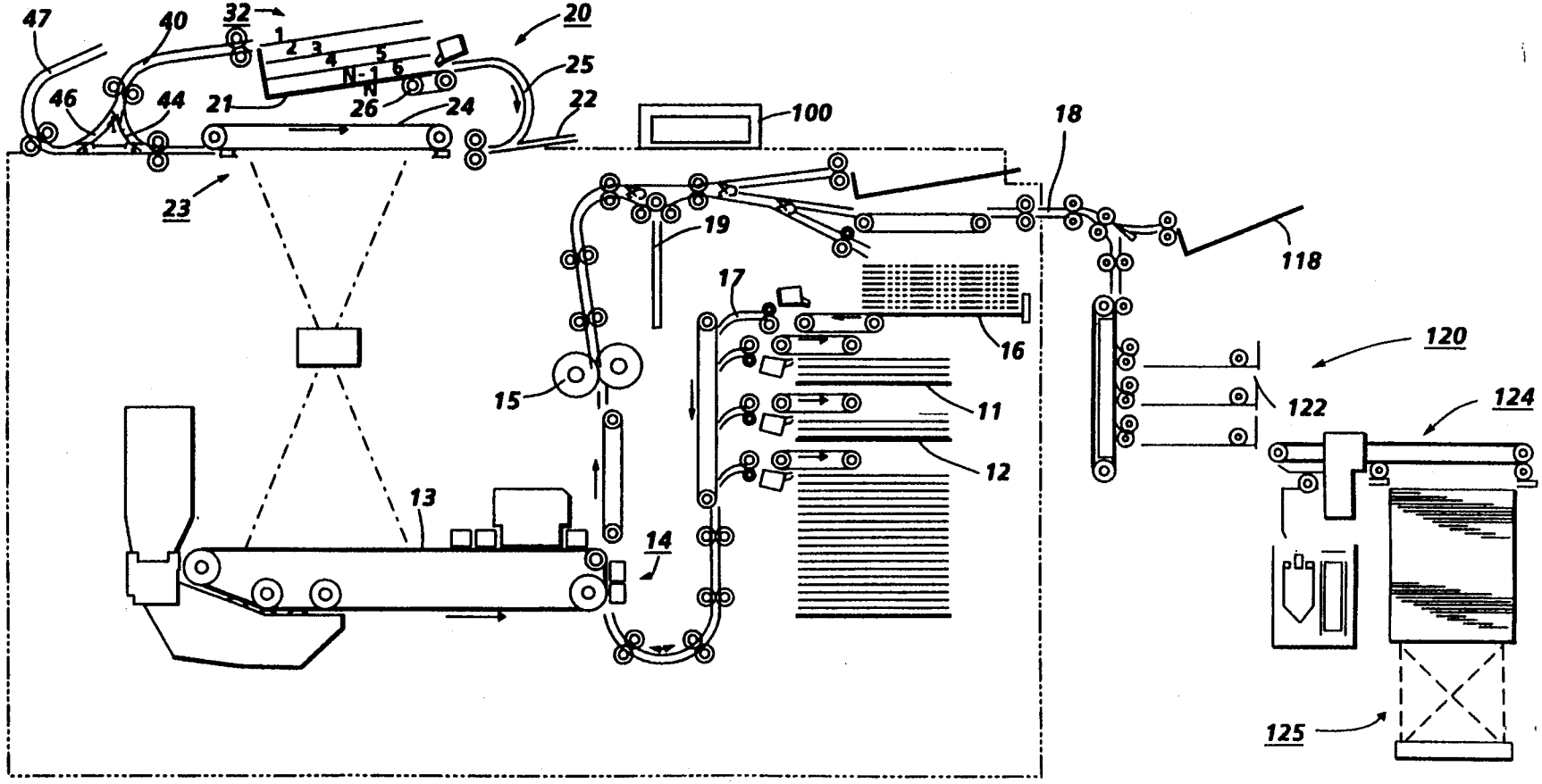
Figure 5:
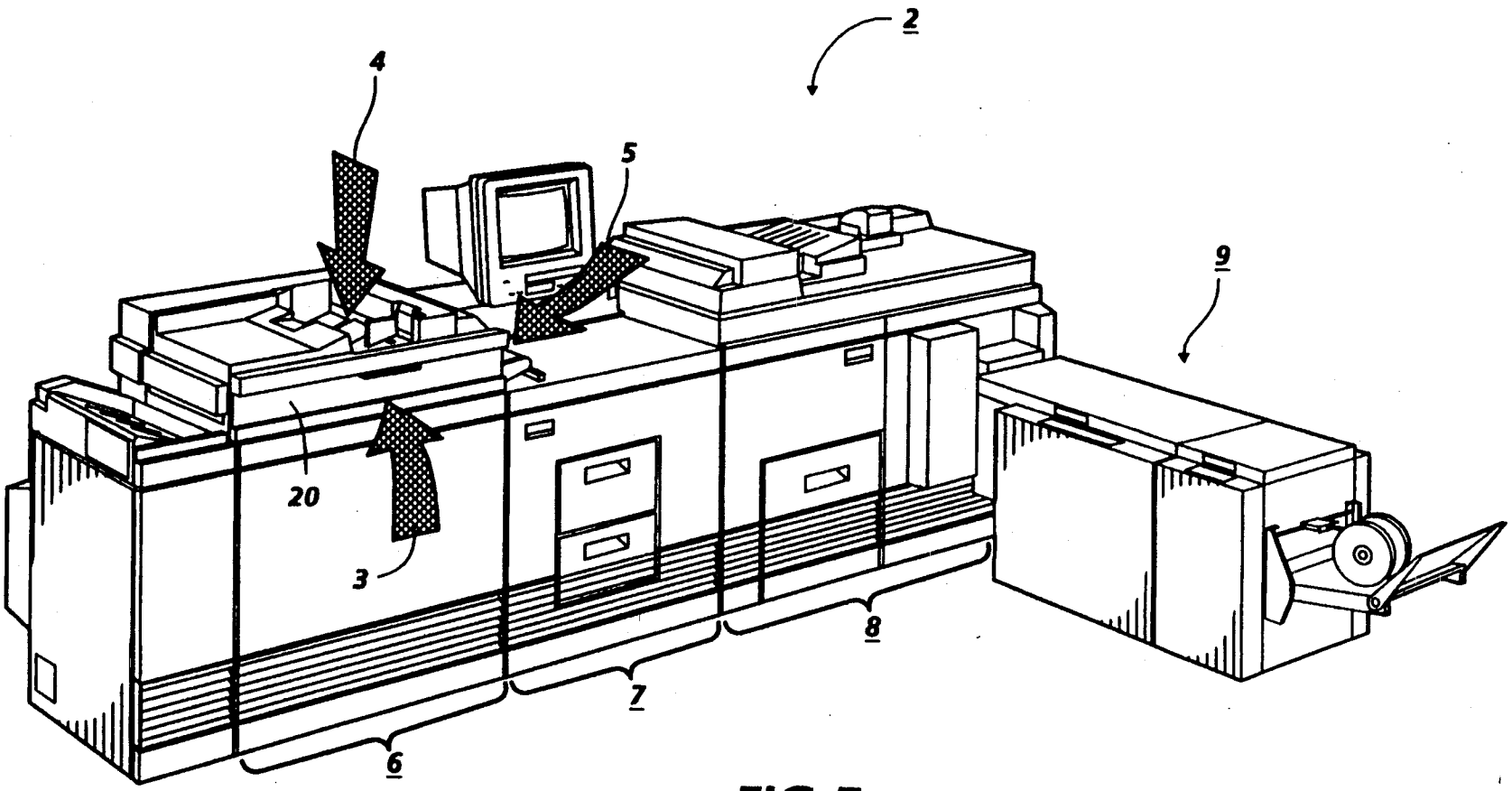

FIG. 4 is a schematic side view of an electrostatographic printing system illustrating the principal mechanical components thereof; and FIG. 5 is a perspective view depicting an electrostatographic printing system incorporating the selectively variable set delivery timing of the present invention as well as a typical external device for receiving print sets from the electrostatographic printing system.

While the present invention will be described with a reference to a preferred embodiment thereof, it will be understood that the invention is not to be limited to the preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds.

Inasmuch as the art of electrostatographic reproduction is well known, the various processing stations employed in the reproduction machines of the present invention will initially be described briefly with reference to FIGS. 4 and 5. It will become apparent from the following discussion that the imaging system of the present invention is equally well suited for use in a wide variety of electrophotographic or other electronic printing systems.

Referring initially to FIG. 5, there is shown an exemplary printing system 2 for processing, printing and finishing print jobs in accordance with the teachings of the present invention. For purposes of explanation, the printing system 2 is divided into a xerographic section 6, a controller section 7, and a finisher section 8. An external finishing device 9 is shown coupled to the finisher section 8 for receiving print sets therefrom. While a specific printing system will be shown and described, the present invention may be used with other types of printing systems, as for example, ink jet, ionographic, laser based exposure systems, etc.

Describing now in further detail the exemplary printing system illustrated in the Figures, FIG. 4 illustrates the printing system shown in FIG. 5 in schematic form. The machine incorporates an exemplary recirculating document handler (RDH) 20 of a generally known type further described in art cited herein, and may be found, for example, in the well known Xerox Corporation model "1075" or "5090" duplicators Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated copy sets from either duplex or simplex original documents circulated by a document handler. As is conventionally practiced, the entire document handler unit 20 may pivotally mount to the copier so as to be liftable by the operator up and away from the platen for alternative manual document placement and copying. In this manner, the exemplary printing system 2 is designed to receive input documents as manually positioned on the platen glass 3 or automatically through the document handler, also known as a recirculating document handler (RDH) 20, via a document handler input tray 4 or a document feeder 5, as illustrated in FIG. 5.

The RDH 20 operates to automatically feed or transport individual registered and spaced document sheets onto and over an imaging station 23, i.e., over the platen of the printing system 2. A platen transport system 24 is provided, which may be an incrementally servo motor driven non-slip or vacuum belt system controlled by the copier controller 100 in a manner taught by above cited references to stop the document at a desired registration (copying) position. For illustrative clarity, a platen is not fully illustrated in schematic FIG. 4. Also for clarity, the illustrated document and copy sheets are drawn here with exaggerated spacing between the sheets being stacked. In actual operation these stacked sheets would be directly superposed upon one another.

The RDH 20 has a conventional "racetrack" document loop path configuration, and preferably has generally known inverting and non-inverting return recirculation paths to the RDH loading and restacking tray 21. An exemplary set of duplex document sheets is shown stacked in this document tray 21. The RDH 20 is a conventional dual input document handler, having an alternative semiautomatic document handling (SADH) side loading slot 22. Documents may be fed to the same imaging station 23 and transported by the same platen transport belt 24 from either the SADH input 22 at one side of the RDH 20, or from the regular RDH input, namely the loading or stacking tray 21, on top of the RDH unit. As noted, the second document feeding input 22 is referred to herein as the SADH input 22, although it is not limited to semi-automatic or "stream feeding" document input feeding; that is, the SADH input 22 is also known to be usable for special "job interrupt" insert jobs.

Normal RDH document feeding input comes from the bottom of the stack in tray 21 through an arcuate, inverting RDH input path 25 to the upstream end of the platen transport 24. Input path 25 preferably includes a known "stack bottom" corrugated feeder-separator belt and air knife system 26, document position sensors (not shown), and a first set of turn baffles and feed rollers for naturally inverting the documents once before copying. Document inverting or non-inverting by the RDH 20 is further described, for example, in the above cited patents U.S. Pat. No. 4,794,429 or 4,731,637, etc.. Briefly, after the documents are copied on the platen imaging station 23, or fed across the platen without copying, they may be ejected by the platen transport system 24 into downstream or off-platen rollers and fed past a gate or a series of gates and sensors. Depending on the position of these gates, the documents are either guided directly to a document output path and then to a catch tray, or, more commonly, the documents are instead deflected by a decision gate, past an additional sensor, and into an RDH return path 40 leading the documents back to tray 21 so that the document set can be continually recirculated. This RDH return path 40 includes reversible rollers to provide a choice of two different return paths to the RDH tray 21: a simplex return path 44 with one inversion; or a reversible duplex return path 46 without an inversion as further explained below. For the duplex path 46 the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, this RDH inverter and inversion path 46, 47 is used only for RDH input tray 21 loaded documents and only for duplex documents. In normal operation, a duplex document has only one inversion per circulation (occurring in the RDH input path 24). By contrast, in the simplex circulation path there are two inversions per circulation, one in each of the paths 24 and 44. Two inversions per circulation equals no inversion. Thus, simplex documents are returned to tray 21 in their original (face up) orientation via the simplex path 44.

The entire stack of originals in the RDH tray 21 can be plurally recirculated and copied to produce a plurality of collated copy sets. The document set or stack may be RDH recirculated any number of times to produce any desired number of collated duplex print sets, that is, collated sets of duplex copy sheets, in accordance with various instruction sets known as print jobs which can be programmed into the controller 100.

Since the copy or print operation and apparatus of the present invention is well known and taught in the cited and other art, the system will not be described in detail herein. Briefly, blank or even pre-printed copy sheets are conventionally fed from paper trays 11 or 12 (or the high capacity feeder tray shown thereunder) to receive a copier document image from photoreceptor 13 at transfer station 14. Such copy sheets are fused in a fuser 15, and output (if they are to be simplex copies), or, temporarily stacked in a duplex buffer tray 16 if they are to be duplexed, for subsequent return (inverted) via path 17 for receiving a second side image in the same manner as the first side. This duplex tray 16 has a finite predetermined sheet capacity, depending on the particular copier design. The completed duplex copy is preferably transported to an integral finishing and stacking module via output path 18. An optionally operated copy path sheet inverter 19 is also provided.

Output path 18 is directly connected in a conventional manner to a generally known bin sorter 120 as is generally disclosed in U.S. Pat. No. 3,467,371 issued Sept. 16, 1969, to J. W. Britt et al., assigned to Xerox Corporation and incorporated in its entirety by reference herein. Bin sorter 120 includes a vertical bin array 122 which is conventionally gated to deflect a selected sheet into a selected bin as the sheet is transported past the bin entrance. An optional gated overflow top stacking or purge tray may also be provided for each bin set. The vertical bin array 122 may also be bypassed by actuation of a gate therein to direct sheets serially onward. The resulting sets of prints are then discharged to finisher 124 which may include a stitcher for stapling print sets together and/or a thermal binder for adhesively binding the print sets into books. A stacker 125 is also provided for receiving and delivering final print sets to an operator or to an external third party device, as contemplated by the present invention.

All copier and document handler and sorter operations are preferably controlled by a generally conventional programmable controller 100. The controller 100 is additionally programmed with certain novel functions and graphic user interface features described herein for the operation of the electrostatographic printing system 2 and the selectively variable set delivery output functions of the present invention. The controller 100 preferably comprises a known programmable microprocessor system, as exemplified by the above cited and other extensive prior art, e.g., U.S. Pat. No. 4,475,156, and its references, for controlling the operation of all of the machine steps and processes described herein. This includes the actuation of the document and copy sheet feeders and inverters, gates, etc.. As further taught in the references, the controller 100 also conventionally provides for storage and comparison of the counts of the copy and document sheets, the number of documents fed and recirculated in a document set, the desired number of copy sets, and other functions which may be input into the machine by the operator through a connecting panel of numerical and other control or through a variety of customized graphic user interface screens. Controller information and sheet path sensors are utilized to control and keep track of the positions of the respective document and copy sheets making up a print set and the operative components of the apparatus by their connection to the controller. The controller 100 may be conventionally connected to receive and act upon jam, timing, positional and other control signals from various sheet sensors in the document recirculation paths and the copy sheet paths. The controller 100 automatically actuates and regulates the positions of sheet path selection gates depending upon which mode of operation is selected and the status of copying in that mode. As shown herein, the machine controller 100 preferably includes a known touch-screen type of integrated operator input control and display which also conventionally operates and changes displays on a user interface display panel, which preferably includes operator selection buttons or switches.

It shall be understood from the above description that multiple print jobs, once programmed, are scanned and printed and finished under the overall control of the machine controller 100. The printer controller controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device. The printer controller initiates a sequencing schedule which is highly efficient in monitoring the status of a series of successive print jobs which are to be printed and finished in a consecutive fashion. The sequencing schedule utilizes various algorithms embodied in printer software to introduce delays for optimizing particular operations.

Typically, such delays are executed by generating a skip pitch, wherein a skip pitch is a unit of time in which the printing system, in a full execution mode with the photoreceptor being charged and discharged, is suppressed from generating an image such that no copy sheet is fed through to the transfer station. It is important to minimize the number of skip pitches in order to maintain optimum system throughput as well as to conserve on the use of consumables within the machine. Some prior art examples of optimizing print skip pitches in a sheet scheduling mode are disclosed in U.S. Pat. Nos. 5,095,342 and 5,095,369, incorporated by reference herein. While these patents describe different forms of skip pitch optimization, they do not take into account the skip pitches introduced when an external third party device is also present in the job sequence. Under these circumstances, the optimization of system throughput requires that the printer controller be provided with information regarding the unload time of the external device as well as the number of sheets in a given print set. In addition, required delays for transporting document sets to a third party device may also be provided by inducing a delay in the finishing subsystem 124, and, more specifically, by holding print sets in a finisher processing station for a predetermined period of time, as for example, by delaying the delivery of sheets from the finisher stacker 125 to the external third party device.

Various types of external third party devices are available from dozens of multinational equipment suppliers for providing specified paper handling and processing capabilities. For example, the Automatic Stapler Folder ASF 135 manufactured by Plockmatic, International AB of Sweden is designed to receive signature sheets containing plural printed page images with a page arrangement such that, when such signature sheets are center folded and nested one inside the other with other signature sheets in a print set, they create a single collated pamphlet or booklet. As such, the previously identified PIockmatic machine may be coupled to an electrostatographic printing system, as for example the Xerox Corporation Model "5390" duplicator, for receiving collated signature sheets therefrom. In addition, a variety of other third party sheet treatment and finishing subsystems are also available in the form of various output devices for performing functions such as sheet rotation, sheet inversion, sheet hole punching, Z folding, sheet insertion, and/or combinations thereof.

With the various types of flexible post-printing finishing activities available and required by various customers, some degree of copy sheet output variability is necessary in order to maintain high productivity. Various print jobs will result in varying output speeds as a function of the processing required by the electronic printing system. Notably, it is inefficient to insert into the printing system a fixed, worse-case delay since various external third party devices will have varying unload time capabilities for receiving output copy sheets and print sets. An optimum throughput can therefore be defined for the purpose of the present invention so as to output print sets from the stacker 125 at a rate substantially equivalent to the unload time of the external third party device. In order to enable optimum productivity, and according to the present invention, optimum print set delivery is accomplished by a combination of induced skip pitches in the electronic printing system as well as induced delays in the finisher subsystem. Clearly, in order to enable optimum productivity, the number of skip pitches induced during the printing operation must be minimized.

The goal of minimizing skip pitches as well as inducing delays in the finisher subsystem is achieved by providing a mechanism whereby an operator can program the external device unload time and the maximum sheet size of each set into the electronic printing system. The unload time is evaluated against the electronic printing system set delivery cycle In response, the set delivery cycle time is adjusted to deliver print sets at a rate which is compatible with the external third party device. Variation of the set delivery time from the printing system is facilitated by using two separate modes: a first mode which is enabled when skip pitches are not required such that the set delivery cycle is optimized in the finisher subsystem without any loss in electrostatographic processing productivity; and a second mode which is enabled when the third party device unload time is greater than the machine set delivery cycle such that incremental skip pitches are required. Various combinations of induced skip pitches as well as finisher subsystem timing delays may be generated in order to achieve a substantially equivalent timing match between the printing system and the external device, thus optimizing productivity Referring now to FIGS. 1 and 2, there is shown a pair of flow charts for optimizing the selectively variable set delivery output timing from the electrostatographic printing machine by means of varying both the set delivery timing in the finisher subsystem of the electronic printing system (FIG. 1), and by determining the optimum number of skip pitches required for a given print job (FIG. 2). Computer programs for setting a set delivery timing delay and determining whether skip pitches are required are provided in Appendices A and B, respectively. As will be recognized, Appendix A sets forth a first routine for determining set delivery timing from the finisher subsystems based on the inherent throughput time of the electronic printing systems, as well as the minimum unload time of the third party device. While Appendix B sets forth a second routine for determining an optimum number of skip pitches required in the printing process as a function of the number of sheets in a set. This information is input into nonvolatile memory (NVM) via the controller 100.

Figure 1:
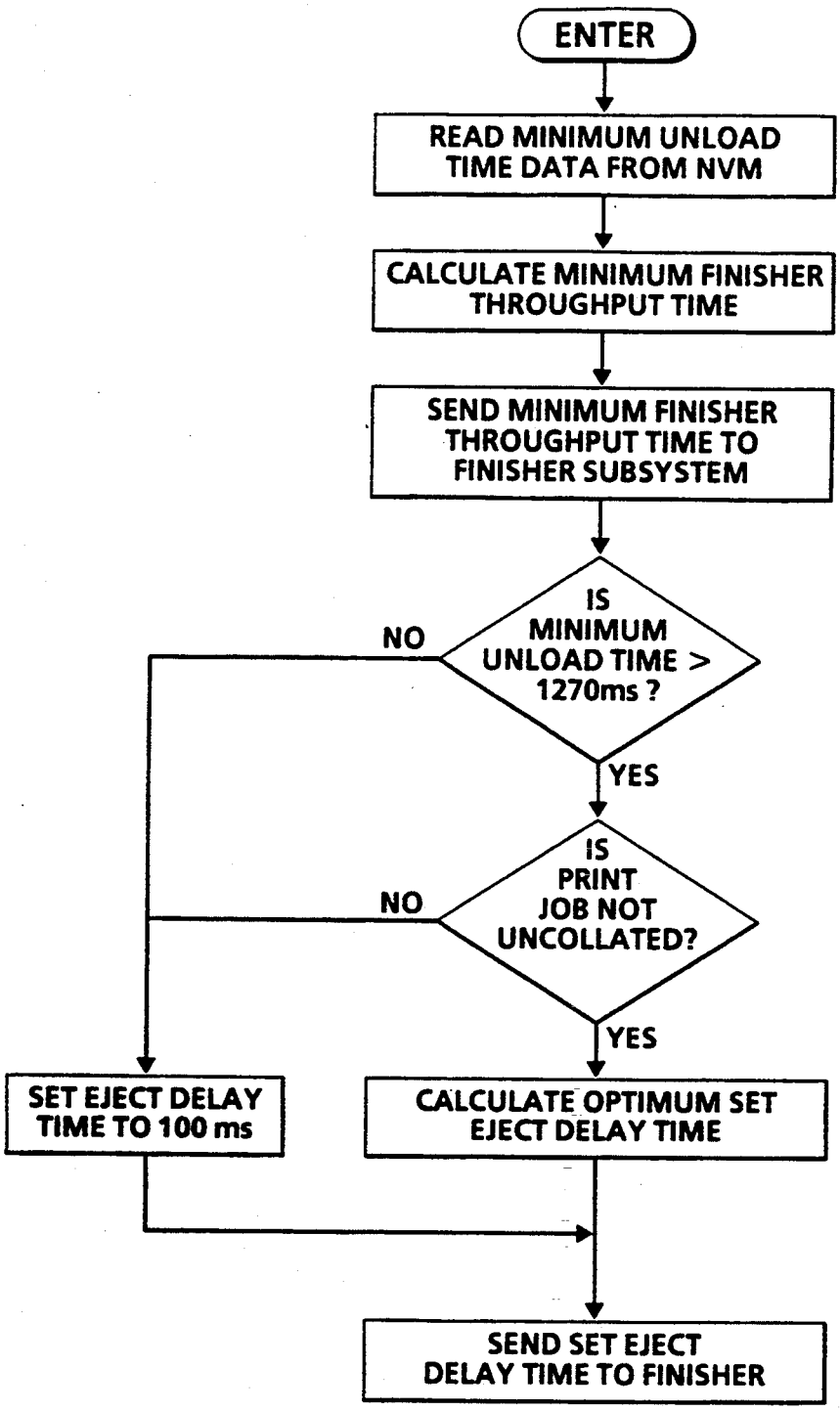
FIGS. 1 and 2 show flow charts of a set delivery algorithm for enabling the operator adjustable set delivery timing feature of the present invention.
Figure 2:
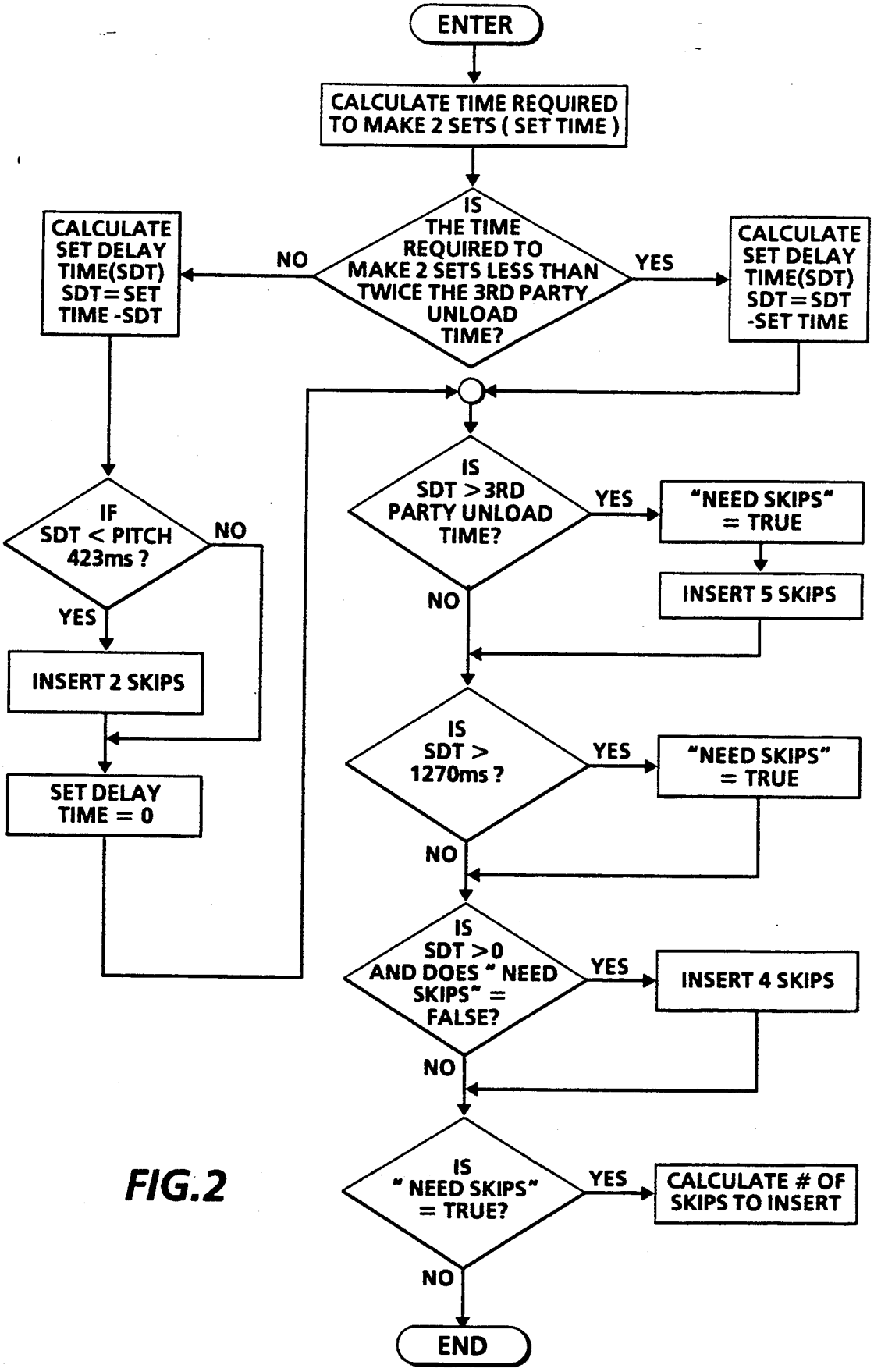

In the routine of Appendix A and FIG. 1, the minimum external device unload time is entered into the nonvolatile memory (NVM), and read by the system controller. This information is processed to calculate a minimum finisher throughput time (dfa Time) based upon the amount of time required to move a set through the finisher as well as a predetermined time equivalent to three pitches in the printing process. This minimum finisher throughput time is then transmitted to the finisher. Thereafter, a set eject delay time is determined, dependent upon whether the minimum external device unload time is greater than three pitches (1270 ms) as well as whether the print job is collated or uncollated That is, if the minimum third party unload time is greater than 1270 ms and the job is collated, a delay based on the finisher processing speed as well as the minimum unload time of the third party device will be established in the finisher. Otherwise, if the minimum unload time of the third party device is less than a predetermined time and the print job is collated or uncollated, a default delay value (in this case, 100 ms) is transmitted to the finisher system.

According to the second routine of the present invention (shown in Appendix B and in FIG. 2), a determination of whether skip pitches are required and a calculation of the appropriate number of such skip pitches so required, is provided It will be seen from the computer program of Appendix B that the calculation of skip pitches encompasses a parameter containing information regarding the highest number of pages or sheets in a given set to determine the amount of time required to make two sets (set time) as well as the delay time required to deliver a set to a third party device synchronous with the unload time of that device (set delay time). The variable set delay time is assigned one of two values depending on whether the set delay time is greater or less than the time required to make a print set. If the set delay time is greater than the time required to make two print sets then the set delay time is given the value of the difference between twice the third party device unload time and the time required to make two print sets. Otherwise, if the set delay time is less than the time required to make two sets the set delay time is assigned the value of the difference between the time required to make two print sets and twice the third party device unload time. Under these conditions, where the set delay time is less than the time required to make two sets and twice the third party device unload time is less than or equal to the pitch time of the xerographic process, then two skip pitches are automatically induced in the xerographic printing process. Otherwise, if the difference between the time required to make two sets and twice the third party device unload time is greater than the pitch time of the xerographic process, no set delay time is induced into the process. However, if the set delay time is greater than the time required to process one pitch in the xerographic process, a default state of two skip pitches will be induced into the xerographic printing process and the set delay time will subsequently be initialized to zero.

In the case where the time required to make two print sets is less than twice the third party unload time, the set delay time will be calculated as the difference between twice the third party unload time and the time required to make two print sets. If the resultant set delay time is greater than the third party unload time or greater than 1,270 milliseconds (equivalent to three pitches) the program will be directed into a routine in which the number of skip pitches will be calculated. Otherwise, if the set delay time is greater than zero but none of the above conditions have been met, a default mode of four skip pitches will be induced in the xerographic printing process.

In order to calculate the number if skips to be inserted into the xerographic printing process a "need skips routine" is initialized wherein the set delay time is divided by the pitch time (423 milliseconds in this case) to calculate the number of skip pitches necessary to be inserted into the xerographic printing process.

Figure 3:
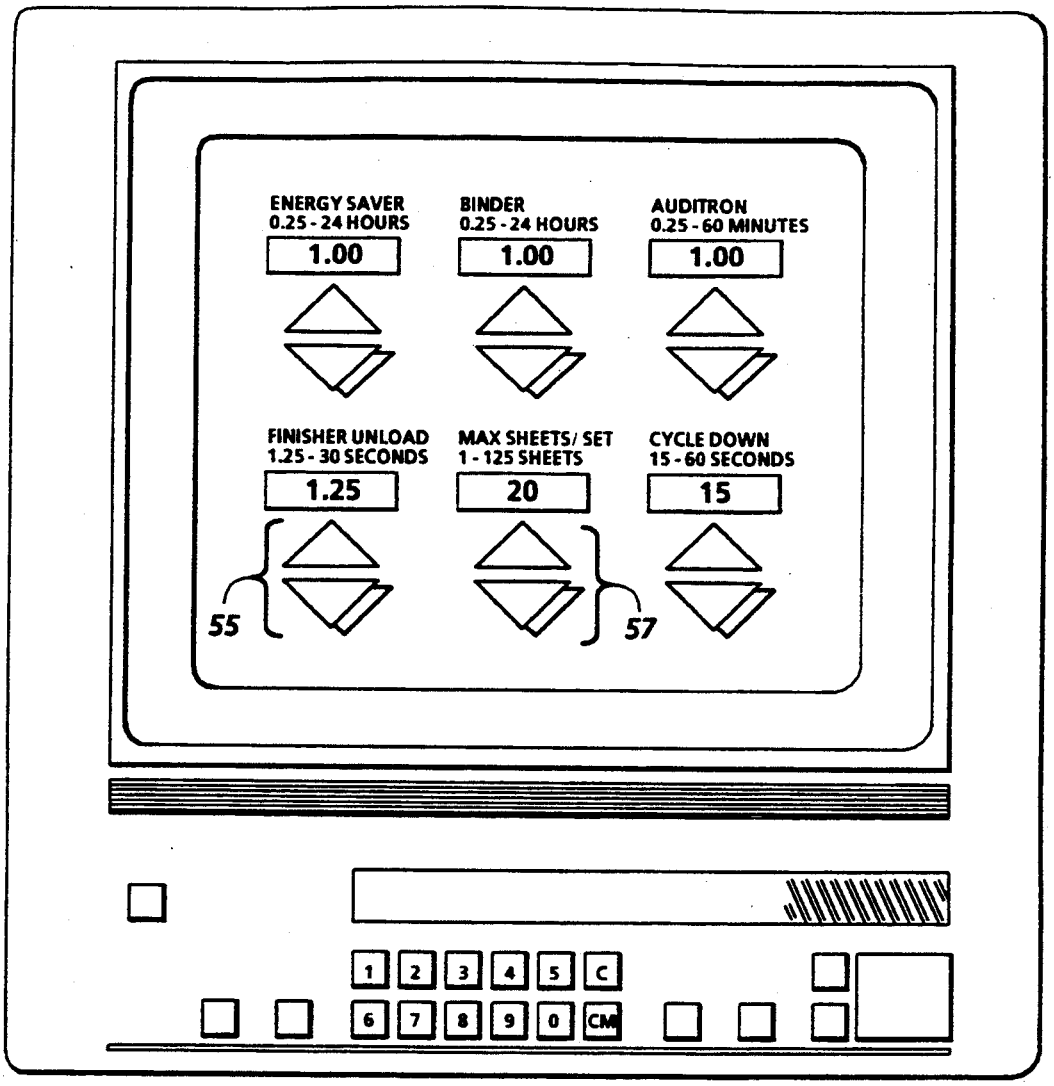
FIG. 3 is a pictorial view of a touch screen showing the operator selectable controls for selectively adjusting set delivery output from the machine.

The maximum numbers per print set as well as the minimum unload time of the third party device is conventionally input into the electrostatographic printing machine through a graphic user interface device illustrated in FIG. 3. By way of example, the graphic user interface device may be a touch screen having a plurality of operator actuatable buttons displayed thereon such as a numerical keyboard for selecting numbers of copies, magnification control buttons, image contrast buttons, etc. FIG. 3 shows an external third party device timer screen used to input appropriate minimum unload times and maximum sheet per set information. Using this graphic screen, buttons 55 and 57 allow the operator to input the minimum unload time of the third party device, and the maximum sheets per set, respectively. In order to input the finisher unload time, the appropriate upper or lower button of selection set 55 is pressed. Likewise, in order to vary the maximum sheet per set information input into the controller, the appropriate upper or lower input button 57 is pressed. Alternatively, the keypad of the lower end of the graphic user interface device may be utilized to input information. The numerical amount of the finisher unload time or the maximum sheets per set is displayed in a window directly above the selector buttons.

In recapitulation, the electrostatographic printing machine of the present invention is adapted to allow a customer or operator to selectively vary the output timing of the system so as to be compatible with the unload time of an external device to which output sets are delivered. An operator can automatically provide for selective output timing from the electrostatographic printing machine via a user interface which transmits an electronic signal to control circuitry for delaying delivery of print sets from a finisher and/or inducing skip pitches in the xerographic printing process so as to produce delays therein. A graphic user interface device is also provided for inputting appropriate operating parameters such as unload time and number of sheets per set.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

APPENDIX A

```
OS.ReadNVMMemory[@NVM.unloadTime, RECAST[@min3rdParty], 2];
 --Time in ms
 --[,minUnloadPitches] ← Math.DivDword[0,min3rdParty,423];
 --Converting unload time to pitches
 dfaTime ← 380 + (min3rdParty - 1270);
                                                        START
FBNfromJMN.NonSegmentReceiver[Env.DataIndex.dfaThroughPutTime,
dfaTime];
   IF min3rdParty > 1270 AND ((Select.finisherSelections &
Select.uncollated) <>
                        Select.uncollated)
 THEN
  setEject ← 380 + (min3rdParty - 1270);
  --Used 380 because of the time it takes to move bin (Sandy).
  --Must verify later for optimization KHS 03-31-93
 ELSE
  setEject ← 100;
 END IF;
                                                        START
FBNfromJMN.NonSegmentReceiver[Env.DataIndex.setEjectDelayTime,
setEject];
```

APPENDIX B

```
StdSkips : PRIVATE PROCEDURE [arg1: CARDINAL] =
 --arg1 contains SchedLL.highestPage

 setTime, tempSkipsNeeded: CARDINAL;
 setDelayTime, skipsNeeded. CARDINAL;

 needSkips : BOOLEAN;
 --adjust   : SHORT UNSPECIFIED;

 ENTER
  needSkips ← FALSE;
```

```
skipsNeeded ← 0;
-- IF SchedLL.min3rdParty > 1270
-- THEN
--  setEject ← 100 + (SchedLL.min3rdParty - 1270);
--ELSE
 -- setEject ← 100;
--END IF;

--IF (Sched.copyMode = simpSimp) OR (Sched.copyMode = simpDup)
--THEN
 setTime ← ((2 * arg1) * stdPitchTime);
--ELSE
 --setTime ← ((1 * arg1) * stdPitchTime);
--END IF;


        setDelayTime ← (SchedLL.min3rdParty * 2);

        IF setDelayTime > setTime
        THEN
         setDelayTime ← setDelayTime - setTime;
        ELSE
         setDelayTime ← setTime - setDelayTime;
         IF setDelayTime < = stdPitchTime
         THEN
          skipsNeeded ← 2;
         END IF;
          setDelayTime ← 0;
         END IF;


         IF setDelayTime > SchedLL.min3rdParty
         THEN
          needSkips ← TRUE;
          skipsNeeded ← 5;
         END IF;
         IF setDelayTime > 1270
```

```
THEN
 needSkips ← TRUE;
END IF;

IF (setDelayTime > 0) AND (needSkips = FALSE)
THEN
 skipsNeeded ← 4;
END IF; --Added this IF statement to catch borderline cases 04-
20-93 KHS

IFneedSkips
THEN
[,tempSkipsNeeded]←Math.DivDword[dummyValue,setDelayTime,stdPitch
Time];
        --had to place a dummy value here and use DivDword because
DivWord expects a byte
        --as a divisor and stdPitchTime is a word.  DivDword allows the
divisor to be a
        --word
        --setEject ← setEject + setDelayTime;
        skipsNeeded ← skipsNeeded + tempSkipsNeeded + 2;
        --Add 1 for rounding purposes
  END IF;

  IF ((needSkips) OR (skipsNeeded > 0)) AND ((Sched.qtyLeft > 1) OR
(Select.qtySelected > 1))
  THEN
   Schut.flashmode ← skipsNeeded;
        SendSkipSegments[Schut.flashmode,Schut.flashmode,
              Schut.setStackCount,Schut.setStackCount];
  END IF;

                                                        --START
FBNfromJMN.NonSegmentReceiver[Env.DataIndex.setEjectDelayTime,
setEject];
 END PROCEDURE StdSkips;
```

We claim:

1. An apparatus for delivering successive print sets to an external device at a selectively variable time interval, comprising:

means for compiling a plurality of print sheets to produce a print set, said compiling means being adapted to deliver print sets to the external device at a predetermined unload rate;

means for selectively varying the time interval at which individual print sets are delivered from said compiling means to the external device so as to be compatible with the predetermined unload rate thereof;

printing means for printing said print sets and delivering said print sets to said compiling means; and control means adapted to receive electrical signals representative of parameters including minimum unload time for the external device and number of print sheets per print set for calculating a minimum time interval at which print sets can be delivered from said compiling means to the external device, wherein said control means includes a graphic user interface device for inputting the parameters thereto.

2. The apparatus of claim 1, wherein said means for selectively varying the time interval at which individual print sets are delivered from said compiling means to the external device includes means for generating a processing delay within said compiling means.

3. The apparatus of claim 2, further including printing means for printing said print sets and delivering said print sets to said compiling means.

4. The apparatus of claim 3, wherein said means for selectively varying the time interval at which print sets are delivered to the external device further includes means for generating skip pitches in said printing means to delay arrival of print sheets to said compiling means.

5. The apparatus of claim 3, further including control means adapted to receive electrical signals representative of parameters including minimum unload time for the external device and number of print sheets per print set for calculating a minimum time interval at which print sets can be delivered from said compiling means to the external device, 6. The apparatus of claim 1, wherein said compiling means includes a plurality of bins, each bin being adapted to receive a print set.

7. The apparatus of claim 6, wherein said means for generating a processing delay within said compiling means includes means for holding an individual print set for a predetermined period of time.

8. The apparatus of claim 1, wherein said graphic user interface device includes a touch screen for inputting the parameters.

9. The apparatus of claim 8, wherein said graphic user interface device further includes a display means for displaying the parameters.

10. An apparatus for delivering successive print sets to an external device at a selectively variable time interval, comprising:

means for compiling a plurality of print sheets to produce a print set, said compiling means being adapted to deliver print sets to the external device at a predetermined unload rate;

means for selectively varying the time interval at which individual print sets are delivered from said compiling means to the external device so as to be compatible with the predetermined unload rate thereof, including means for determining an amount of time required to produce two print sets;

means for comparing the time required to produce two print sets against twice the predetermined unload rate of the external device; and means for calculating print set delay time corresponding with the predetermined unload rate of the external device printing means for printing said print sets and delivering said print sets to said compiling means; and control means adapted to receive electrical signals representative of parameters including minimum unload time for the external device and number of print sheets per print set for calculating a minimum time interval at which print sets can be delivered from said compiling means to the external device.

11. The apparatus of claim 10, wherein said means for selectively varying the time interval at which print sets are delivered to the external device further includes means, responsive to said means for calculating a print set delay time, for generating an optimum number of skip pitches in said printing means.

12. An electrostatographic printing apparatus for printing and finishing a plurality of print jobs, comprising:

means for printing a plurality of print sheets;

finishing means for compiling a plurality of said print sheets in accordance with a particular print job to produce a plurality of print sets, said finishing means being adapted to deliver said print sets to an external device adapted to receive print sets at a predetermined unload rate;

means for selectively varying a time interval at which print sets are delivered from said finishing means to the external device so as to be compatible with the predetermined unload rate of the external device; and control means adapted to receive electrical signals representative of parameters including minimum unload time for the external device and number of print sheets per print set for calculating a minimum time interval at which print sets can be delivered from said finishing means to the external device, wherein said control means includes a graphic user interface device for inputting the parameters thereto.

13. The electrostatographic printing apparatus of claim 1, wherein said means for selectively varying a time interval at which print sets are delivered from said finishing means to the external device includes means for generating a processing delay within said finishing means.

14. The electrostatographic printing apparatus of claim 13, further including control means adapted to receive electrical signals representative of parameters including minimum unload time for the external device and number of print sheets per print set for calculating a minimum time interval at which print sets can be delivered from said finishing means to the external device.

15. The electrostatographic printing apparatus of claim 12, wherein said finishing means includes bin sorting means having a plurality of sorter bins, each sorter bin being adapted to receive an individual print set.

16. The electrostatographic printing apparatus of claim 15, wherein said means for generating a processing delay within said finishing means includes means for holding a print set for a predetermined period of time.

17. The electrostatographic printing apparatus of claim 16, wherein said means for selectively varying the time interval at which print sets are delivered from said finishing means to the external device further includes means for generating skip pitches in said printing means to delay arrival of print sheets to said finishing means.

18. The electrostatographic printing apparatus of claim 12, wherein said graphic user interface device includes a touch screen for inputting the parameters.

19. The electrostatographic printing apparatus of claim 18, wherein said graphic user interface device further includes a display means for displaying the parameters.

20. An electrostatographic printing apparatus for printing and finishing a plurality of print jobs, comprising:

means for printing a plurality of print sheets;

finishing means for compiling a plurality of said print sheets in accordance with a particular print job to produce a plurality of print sets, said finishing means being adapted to deliver said print sets to an external device adapted to receive print sets at a predetermined unload rate; and means for selectively varying a time interval at which print sets are delivered from said finishing means to the external device so as to be compatible with the predetermined unload rate of the external device, including means for determining time required to produce two print sets;

means for comparing the time required to produce two print sets against twice the predetermined unload rate of the external device; and means for calculating print set delay time corresponding with the predetermined unload rate of the external device; and control means adapted to receive electrical signals representative of parameters including minimum unload time for the external device and number of print sheets per print set for calculating a minimum time interval at which print sets can be delivered from said finishing means to the external device.

21. The electrostatographic printing apparatus of claim 20, wherein said means for selectively varying the time interval at which print sets are delivered from said finishing means to the external device further includes means, responsive to said means for calculating print set delay time, for generating an optimum number of skip pitches in said printing means.

* * * * *